US007438361B1

(12) United States Patent
Huang

(10) Patent No.: US 7,438,361 B1
(45) Date of Patent: Oct. 21, 2008

(54) SEAT BACK CONSTRUCTION FOR CHAIRS

(76) Inventor: William Huang, 5353 Jillson St., Commerce, CA (US) 90040

( * ) Notice: Subject to any disclaimer, the term of this patent is extended or adjusted under 35 U.S.C. 154(b) by 0 days.

(21) Appl. No.: 11/957,682

(22) Filed: Dec. 17, 2007

(51) Int. Cl.
*A47C 7/16* (2006.01)
*A47C 7/24* (2006.01)

(52) U.S. Cl. ..... 297/452.18; 297/452.56

(58) Field of Classification Search ..... 297/452.18, 297/452.58, 452.59, 452.62, 228.13, 452.56
See application file for complete search history.

(56) References Cited

U.S. PATENT DOCUMENTS 2,121,130 A * 6/1938 McGowen ..... 297/287
2,333,311 A * 11/1943 Greitzer ..... 297/452.59
2,371,954 A * 3/1945 Cunningham ..... 267/111
3,091,497 A * 5/1963 Houser ..... 297/450.1
3,815,955 A * 6/1974 Gibilterra ..... 297/295
4,844,539 A * 7/1989 Selbert ..... 297/228.13

* cited by examiner

*Primary Examiner*—Milton Nelson, Jr.
(74) *Attorney, Agent, or Firm*—Jen-Feng Lee

(57) ABSTRACT

An improved seat back construction is presented herein, so that the frame can easily be produced by metal rammed and bent into shape, which is relatively inexpensive for producing shapes of differing design without huge quantity. Coupling with a wood frame of same shape, a fabric is then overlaid onto the combined frame and tightened/wrapped around by leather, which is sewed to the fabric/wood frame on one side and zipped to the fabric on the other side, producing a nice-looking outer edge of leather, while allowing the construction of elastic and comfortable seat back to be made at low cost, responding to changing design needs, shorter life cycle of products.

4 Claims, 1 Drawing Sheet

SEAT BACK CONSTRUCTION FOR CHAIRS

FIELD AND BACKGROUND OF THE INVENTION

The present invention relates generally to an improved design and construction of back support for chairs and seats, for use in the furniture industry.

As modern living standards move forward, people are expecting better seat and chair construction. New and improved furniture design, particularly related to that of chairs and seat backs, is highly valued, since the time people have to spend in home and office settings entails the need for better comfort and ergonomic consideration. The back support provided to users and efficiently adding to user comfort has been a hot area in the seat back industry.

Currently, there is a type of seat back that is constructed from a layer (or two layers) of fabric spread and tensioned around a perimeter frame, forming a seat back with sufficient elasticity (due to the inherent nature of the fabric) for support and comfort.

The way to construct the aforesaid "fabric back" seat back is by two matching plastic frames that pinched or squeezed a layer of fabric in between, and then secure and tighten the two frames with a plurality of screws.

The drawbacks of such construction include the cost of molding for plastic injection for the production of the frame, since the molding costs for the frames (which consist of matching groove feature, or other interlocking, meshing feature to pinch/squeeze the fabric in between) can vary, reflecting to the changing sizes and shapes of different chairs. The drawback also includes the loosening of the fabric, even though tightened after leaving factory, through use over time, entailing the use of an additional central column, either vertical or horizontal, for purpose of maintaining the tautness of the fabric. The addition of a central column certainly adds to the cost of production.

Thirdly, the plastic frames are the outer edge of the seat back and are not aesthetically appealing.

In light of the business environment where the product life cycle is short, yet the consumer demands are ever changing, necessitating varied and different design needs, manufacturers are constantly looking for economic ways for producing goods that are responsive to the current trends.

The cost of tooling for plastic molding, in the case where seat back frame is made of plastic injection, is oftentimes higher than metal ramming and bending, unless the quantity of such plastic injection is substantially large enough to justify the cost of molding.

As a result, using wood frame that allows fabric to be nailed in and sewn in to the wood frame, which is then coupled to a metal frame, is a better way of producing changing shape/design for seat back while the quantity of production is limited.

OBJECTS AND SUMMARY OF THE INVENTION

Present invention aims to disclose an improved seat back construction that will be cost-effective, lasting, simple and visually appealing, so that manufacturers can produce the fabric back chair with elastic support at lower cost.

DESCRIPTION OF THE DRAWINGS

The accompanying drawings, which are incorporated in and constitute a part of this specification, illustrate the preferred embodiments of the invention and together with the description, serve to explain the principles of the invention.

A brief description of the drawings is as follows.

DETAILED DESCRIPTION OF THE PREFERRED EMBODIMENT

Figure 1:
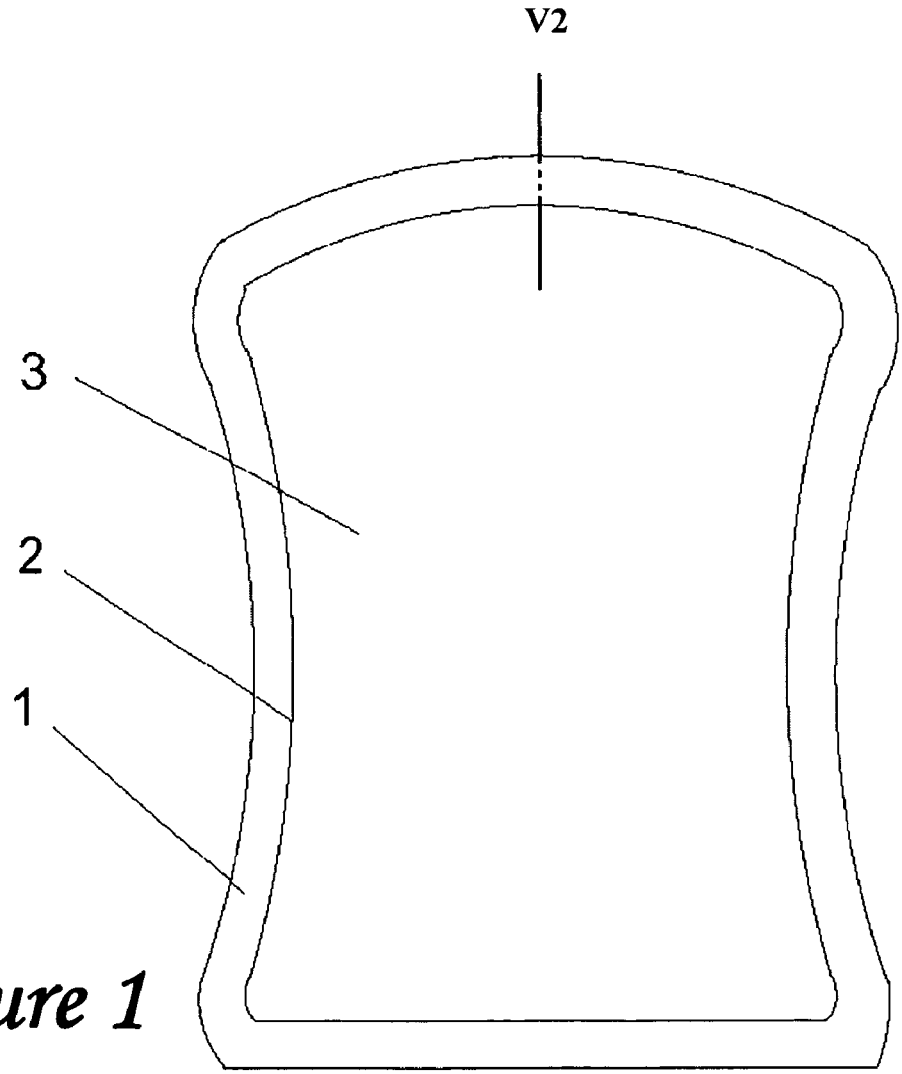
FIG. 1 shows the front view of the seat back construction of present invention, where dashed cutline V2 shows the cross-sectional view as represented in FIG. 2.

In FIG. 1, a seat back frame is shown. Fabric 3 is spread and tensioned around said frame, which is made up of a metal frame 5 and a wood frame 7 (see FIG. 2).

Figure 2:
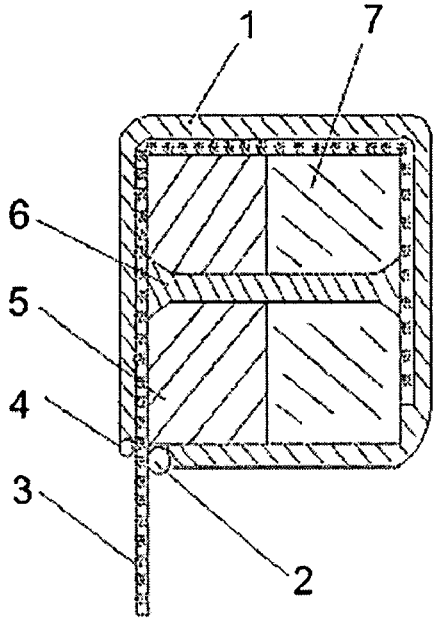
FIG. 2 shows the partial cross-section profile view V2 of the frame for the seat back construction of present invention.

A dashed cutline V2 is shown on FIG. 1, where the cross-sectional view along the V2 cutline is represented in FIG. 2, disclosing the construction of frame according to present invention.

Metal frame 5 can be made from strips that were cut from metal plates according to desired shape or design. Based upon the same shape/design, wood frame 7 is also made. Wood screws 6 (or rivet screws) are used to secure the metal frame 5 and wood frame 7 together.

A piece of fabric 3 is pre-cut to the size a little bit bigger than the size of said metal/wood frame 5/7, having extra slack portions of 4-5 centimeters protruding beyond the perimeter of said metal/wood frame 5/7.

A wrapping leather 1 is used to wrap around said fabric 3 when it is overlaid on the metal/wood frame 5/7. Said leather 1 is sewn to said wood frame 7 along the perimeter point 4, while a zipper 2 is sewn to the other side of said metal/wood frame 7 along the perimeter point opposite of point 4, separated by fabric 3, so that leather 1 is joined to fabric 3 by said zipper 2, along the frame 5/7 perimeter.

Fabric 3 will be secured to wood frame 7 as necessary by using a nail gun as the process of sewing along point 4 and tightened when the leather 1 is zipped to attach to fabric 3 (on the other side of the sew point 4), resulting in a seat back that looks nice and is easy and cost-effective to produce.

The cost associated with the tooling of a metal ramming/pressing is relatively lower than that of plastic molding and injection, and thus suitable for production of new design having small order amount.

In a market where there is constant change being brought up, the simple yet nice-looking way of seat-back design will give manufacturers an edge in meeting the market demands at a lower cost and a shorter response time.

What is claimed is:

1. A seat back construction, comprising:

a. A metal frame;

b. A wood frame;

c. Means for securing said wood and metal frames together;

d. A fabric sized to fit over said frames, having extra rim to wrap around the cross section of said frames; and e. A leather wrapping over said fabric around said frames where a zipper is used to zip said leather to said fabric on one side and said leather is sewn to said fabric on another side, whereby said fabric is tightened to the frames of the seat back.

2. A seat back construction of claim 1, wherein said fabric is secured to said wood frame by a plurality of nails during the process of overlaying said fabric to said frames, as the construction progresses to tighten the fabric.

3. A seat back construction of claim 1, wherein said wood and metal frames are secured together by a plurality of screws.

4. A seat back construction of claim 1, wherein said wood and metal frames are secured together by glue or adhesive of industrial strength.

* * * * *